US007437842B2

(12) United States Patent
Sgambellone

(10) Patent No.: US 7,437,842 B2
(45) Date of Patent: Oct. 21, 2008

(54) FOLDING DISPLAY APPARATUS

(75) Inventor: Joseph Sgambellone, Surry Hills (AU)

(73) Assignee: Popsicle Displays Pty Ltd, New South Wales (AU)

( * ) Notice: Subject to any disclaimer, the term of this patent is extended or adjusted under 35 U.S.C. 154(b) by 593 days.

(21) Appl. No.: 11/207,134

(22) Filed: Aug. 18, 2005

(65) Prior Publication Data

US 2006/0038393 A1 Feb. 23, 2006

(30) Foreign Application Priority Data

Aug. 19, 2004 (AU) ..... 2004904760

(51) Int. Cl.
*G09F 1/08* (2006.01)

(52) U.S. Cl. ..... 40/539; 40/610; 40/606.12; 248/174

(58) Field of Classification Search ..... 40/610, 40/606.12, 124.09, 124.14, 539, 787, 738, 40/754; 248/174, 459; 211/73
See application file for complete search history.

(56) References Cited

U.S. PATENT DOCUMENTS 1,028,147 A * 6/1912 Stranders ..... 40/539
2,160,724 A * 5/1939 Fletcher ..... 40/603
3,141,252 A * 7/1964 Mullen ..... 40/587
3,727,874 A * 4/1973 Wuensch ..... 248/459
3,759,477 A * 9/1973 Hird ..... 248/459
6,347,772 B1 * 2/2002 L'Hotel ..... 248/174
2002/0171023 A1 11/2002 L'Hotel
2007/0284490 A1 * 12/2007 Cox ..... 248/174

* cited by examiner

*Primary Examiner*—Gary C Hoge
(74) *Attorney, Agent, or Firm*—Klauber & Jackson LLC

(57) ABSTRACT

The invention provides an improved display board apparatus which can be folded down when not in use so as to be substantially flat. The apparatus 41 when in its assembled erect condition, has a front panel 12, a rear panel 14 joined to the front panel along opposite vertical sides thereof, and a plurality of elastic traction members 42 attached to the rear panel 14 and arranged to tension rear panel 14 so that the front panel 12 assumes a convex shape. The improvement consists of an integrally formed rearwardly projecting spine 44 in the rear panel 14 extending between the upper and lower edges thereof, the spine 44 being delineated by a plurality of parallel spaced apart fold lines 24, 26, 26'. Each of the elastic traction members 42 extends across and through the spine and has its opposite ends anchored at locations adjacent the sides of the spine 44.

13 Claims, 7 Drawing Sheets

FOLDING DISPLAY APPARATUS

FIELD OF THE INVENTION

The present invention relates to display board apparatus to display printed graphics. In particular the present invention relates to display board apparatus which can be folded down when not in use so as to be substantially flat.

BACKGROUND OF THE INVENTION

A display board can be used as a visual aid during a presentation or to advertise a product or brand. One or more faces of the display board displays printed graphics which provide visual communication.

Display boards are known where columns and panels are held in an assembled position by means of traction devices—refer to U.S. Pat. No. 6,347,772 (L' Hotel). While generally effective, these arrangements suffer from a number of disadvantages. In particular, the columns are difficult to assemble and often require an extra mechanism in order to assist assembly. An additional drawback is that such display boards are bulky, even when disassembled, and cannot be transported easily. A further disadvantage during both assembly and transportation is that the display boards may comprise several parts which increases manual labour during assembly and increases the risk that parts will be lost over time.

One part of a display board which must be transported separately to the display board itself is a stabilising means often referred to as a foot stand. This foot stand stabilises the display board once assembled and usually prevents the display board from falling backwards. The problem exists that once the foot stand is added to the base of the unit it protrudes beyond the front of the display board. This inherently interferes with some of the graphic area at the base of the unit as well as being visually unappealing.

It is an object of the present invention to reduce or eliminate some or all of the disadvantages of display boards described above.

SUMMARY OF THE INVENTION

The present invention accordingly provides an improved display apparatus of the kind comprising a front panel on which visual information is displayed, a rear panel joined to said first panel along its opposite longitudinal margins, and a plurality of vertically spaced traction members attached to the rear panel and arranged, when the display unit is in its in-use position, to tension the rear panel so that the front panel is caused to assume a convex shape, the improvement wherein:

(i) said rear panel includes an integrally formed rearwardly projecting spine extending between the upper and lower edges of the rear panel centrally thereof, said rearwardly projecting spine being delineated by a plurality of parallel, spaced apart fold lines extending longitudinally between said upper and lower edges of the rear panel and, (ii) each of said traction members extends through said spine and has its ends anchored at locations spaced outwardly of the sides of the spine.

With this invention, the rearwardly projecting spine creates a stable footprint for the display unit, and allows the display unit to stand upright without the need for an additional horizontal foot support. Preferably, the spine is formed by three parallel spaced apart fold lines which allow the rear panel under the tension of the traction members, to fold up onto itself so as to create a triangular shaped integral spine which extends the full length of the rear panel.

Desirably, the traction members comprise a plurality of elastic bands spaced vertically along the length of the spine, with each band passing through aligned openings or cut-outs formed in the walls of said spine. By having the elastic bands penetrating through the spine, and located approximately in the plane of the rear panel, the spine is forced to fold outward rather than inward, thus creating an outwardly projecting support which allows the display unit to stand stably upright.

Preferably, the elastic bands are attached by means of slits or cut-outs formed in the rear panel adjacent opposite sides of the integrally formed spine.

Desirably, the front and rear panels are formed from a single blank of a suitable flexible material such as cardboard or plastic, wherein the blank is provided with an approximately centrally located vertically extending fold line which divides the blank into said front and rear panels on opposite sides thereof, and a plurality of vertically spaced horizontally extending fold lines which run the full width of said blank, said horizontal fold lines dividing each of the front and rear panels into a plurality of folding portions which can fold onto one another.

Preferably, the spine has a plurality of vertically spaced apart cut-outs located at the intersections of the vertical fold lines and the horizontal fold lines, so as to allow easy folding without buckling.

Preferably, one side of the blank terminates in a plurality of inwardly folded flaps which when the blank is folded, are affixed, eg by means of adhesive, to the other opposite free margin of the blank to thereby form the front and rear panels which overlie one another when in a flattened condition.

In another form of the invention the rear panel consists of two half panels which have their inner margins in overlapping relationship and joined together by adhesive means. Each half panel is hingedly joined at its outer side to the front panel along a respective fold line. With this arrangement, the join between the two free edges of the blank used to produce the display unit is located in the region of the spine.

BRIEF DESCRIPTION OF THE DRAWINGS

Two preferred embodiments of the present invention will now be described with reference to the accompanying drawings wherein:

FIG. 12 is a front view of the folding display apparatus shown in FIG. 11 in its expanded vertical in-use position, while;

DESCRIPTION OF PREFERRED EMBODIMENTS

Figure 1:
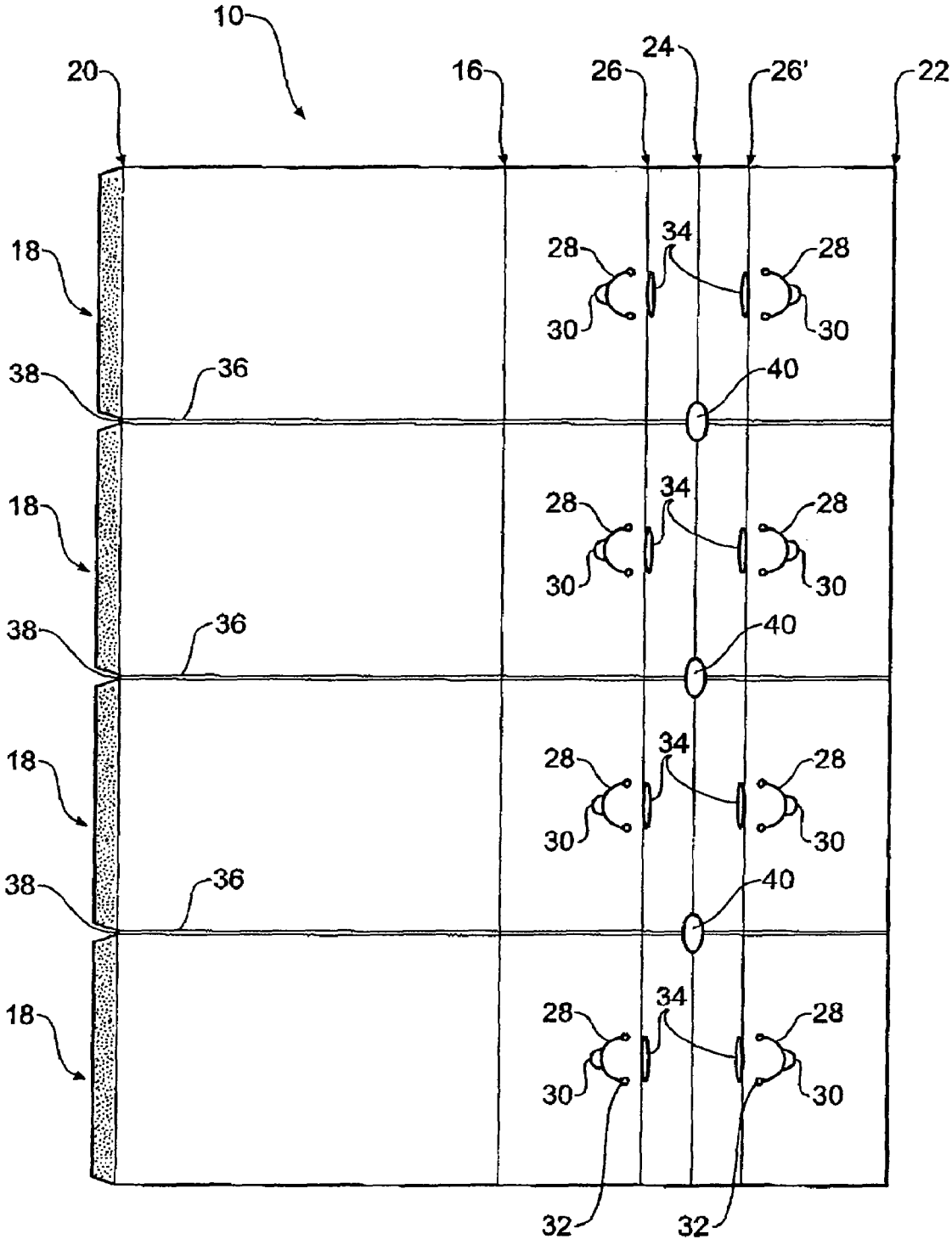
FIG. 1 is a plan view of a blank sheet from which the display apparatus is formed according to a first embodiment of the invention.
Figure 2:
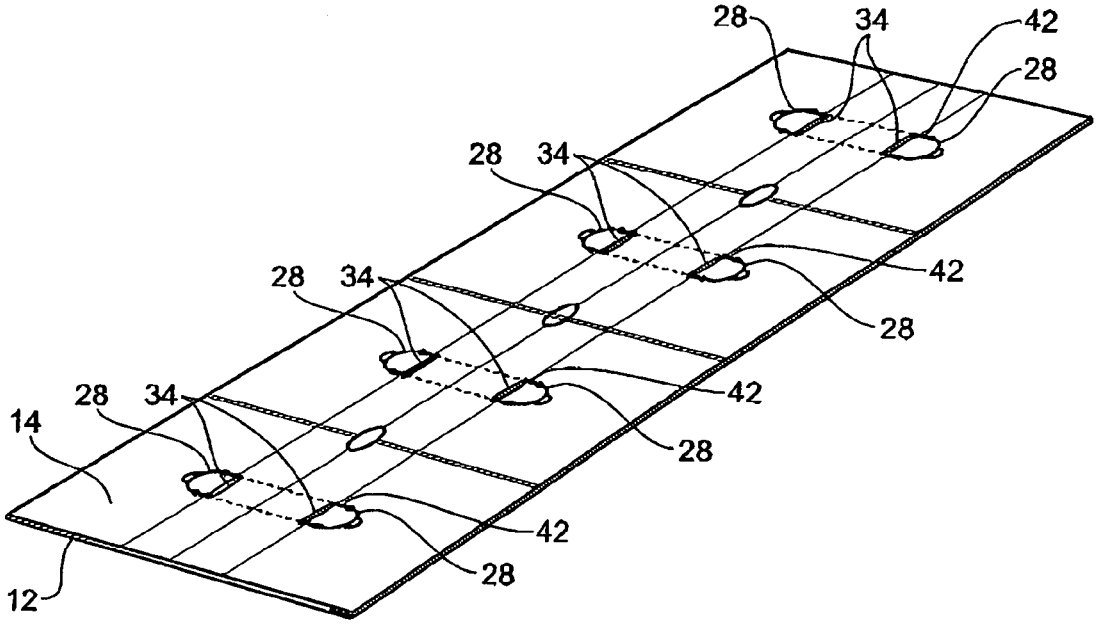
FIG. 2 is a perspective view of the display apparatus in a partly folded, flattened state wherein the blank shown in FIG. 1 has been folded to form the front and the rear panels.

Referring to FIG. 1, there is shown a display unit formed from cardboard sheet (or any other suitable material) blank 10 having a series of intersecting vertical and horizontal fold lines 16, 20, 24, 26, 26' and 36, along which the blank can be folded. The vertical length of the blank is approximately twice that of its horizontal width. The blank 10 is divided into a front panel forming section 12 and a rear panel forming section 14 by fold line 16 running along the centre of the length of the blank. The first panel section 12 terminates along one of its long sides in a plurality of flaps 18 which can be folded at 180° about the fold line 20 in order to fold them over the inner face of the panel section 12. The flaps 18 are then abutted against and adhered, eg by adhesive, to the margin of the rear panel 14, so as to form two panels which can lie flat one on top of the other (refer FIG. 2).

As shown in FIG. 1, the rear panel section 14 is provided with pairs of aligned arcuate slits 28 spaced vertically along the length of the panel 14, with the slits 28 of each pair being located on opposite sides of the fold line 24, adjacent respective fold lines 26, 26'. Each slit 28 terminates at its opposite ends in circular holes 32 which act as elastic band attachment points. It is also an option that the curved slits 28 each have a cut-out 30 to facilitate access to the tab defined by the curved slit 28. Each curved slit 28 has an adjacent slot-like cut-out 34 horizontally aligned therewith and through which an elastic band can pass. In this embodiment each of the slots 34 is located on (or nearly so) a respective fold line 26, 26'.

As also shown in FIG. 1, blank 10 has a plurality of fold lines 36 running across the width of the sheet. These fold lines permit the display apparatus to be collapsed for transportation and/or storage when not in use. A series of V-shaped cut-outs 38 are formed along the free edge of the first panel section 12, coinciding with the ends of the fold lines 36, to allow the display unit to properly fold without buckling the material. It should be understood that any shape of cut-out will suffice and the cut-outs may be U-shaped. Further to this, there are oval shaped cut-outs 40 positioned at the intersection of each fold line 36 and fold line 24. Again these cut-outs permit folding of the sheet without buckling the material.

Figure 3:
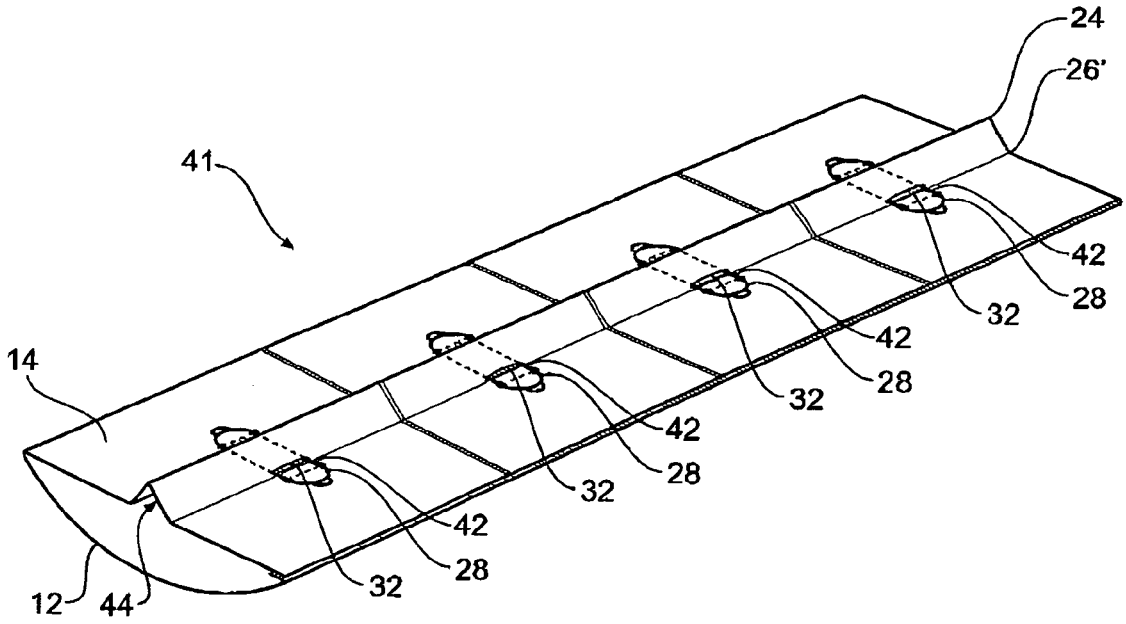
FIG. 3 is a view of the folding display apparatus when in use illustrating the integral self-folding rearwardly projecting spine formed in the second panel.
Figure 4:
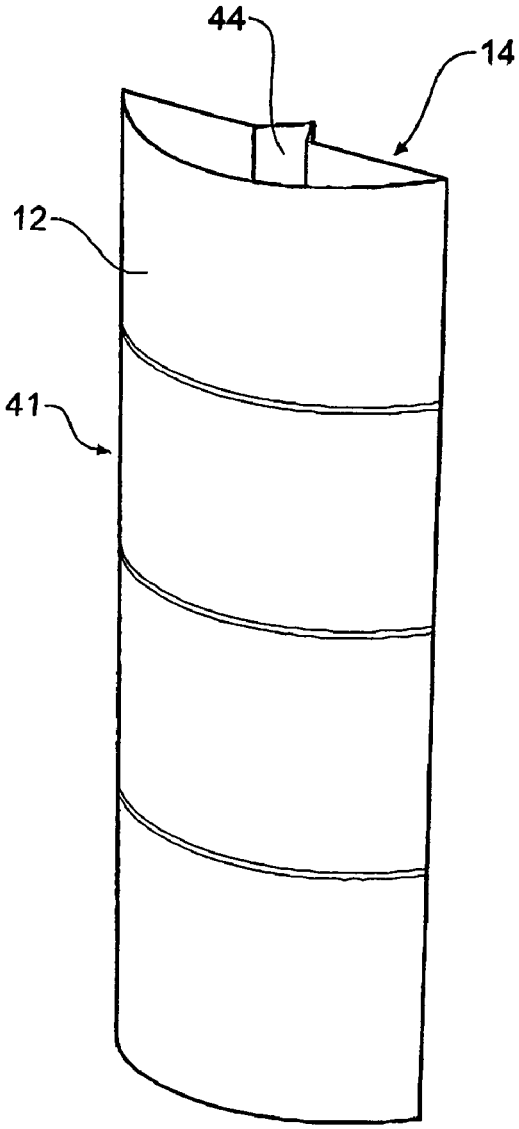
FIG. 4 is a front view of the folding display apparatus in its vertical in-use position for displaying printed graphics, with the front panel being convexly curved.
Figure 5:
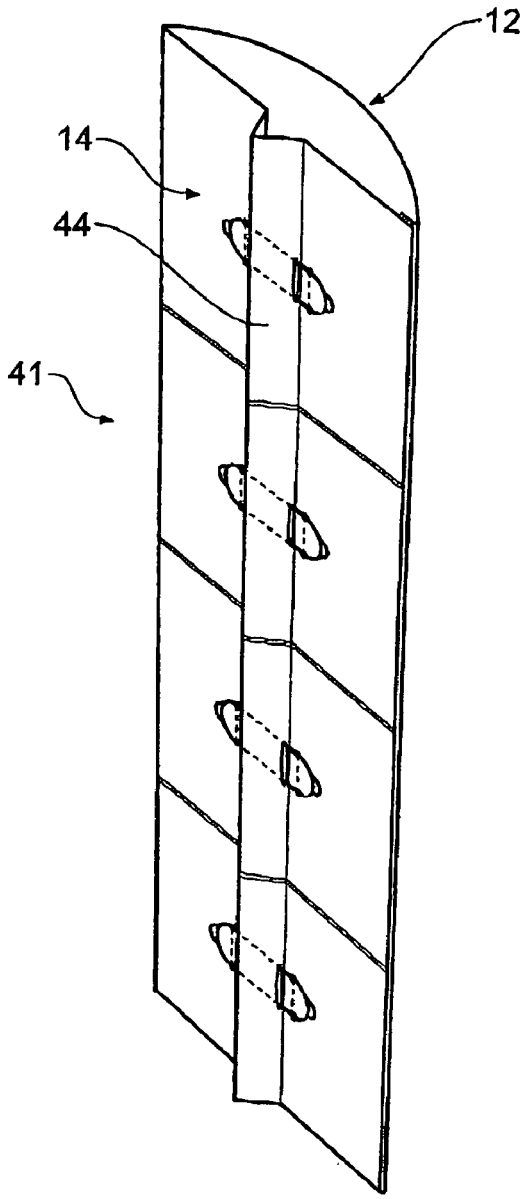
FIG. 5 is a rear view of the apparatus shown in FIG. 4.

Referring now to FIGS. 3 to 5, display apparatus 41 is shown in its erected in-use state where the front panel 12 is convexly curved by virtue of the stresses applied by elastic bands 42 which pass through the slots 34 and locate in the holes 32 at opposite ends of the slits 28. The bands 42 pull the opposite sides of the rear panel 14 inwardly thereby causing the panel 14 to "contract" by folding up on itself to create a rearwardly projecting V-shaped spine 44 defined by the fold lines 24, 26, 26' in the rear panel 14 and also forcing the front panel 12 to assume a convex shape. The elastic bands 42 force the integral spine 44 to fold outward, away from the front panel 12, rather than inward. The combination of the convexly curved front panel 12 and the rearwardly projecting spine creates a stable base which allows the display apparatus to stand upright. The spine acts as a strengthening device, supporting the vertical integrity of the display unit, ensuring that it remains rigid and upright without the tendency to fall backwards. The present arrangement eliminates the need for an additional stabilising support member which is required in known prior art display units. The absence of a separate support member is advantageous in that there is no interference with some of the graphic area at the base of the first panel where printed graphics are displayed.

Figure 6:
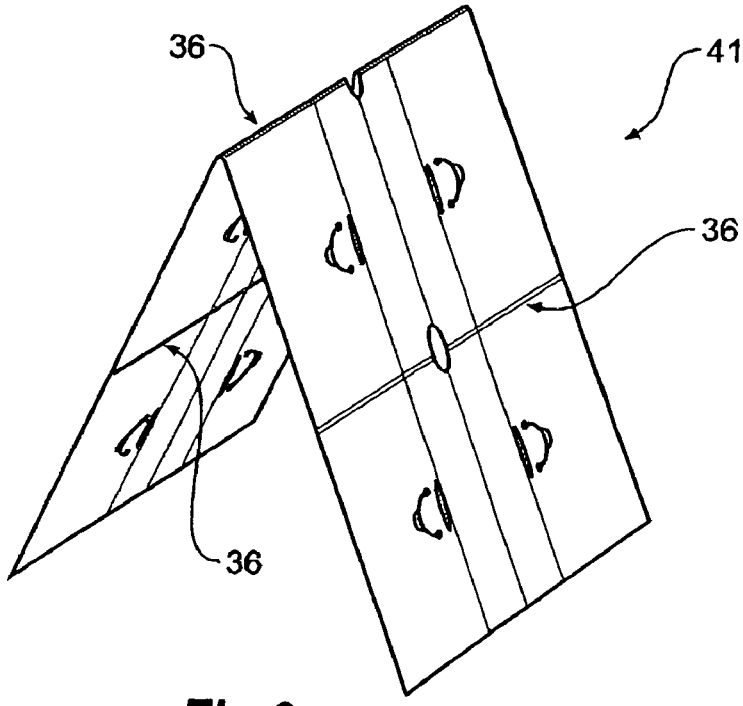
FIG. 6 shows the folding display apparatus when flat and folded in half (without the elastic bands)
Figure 7:
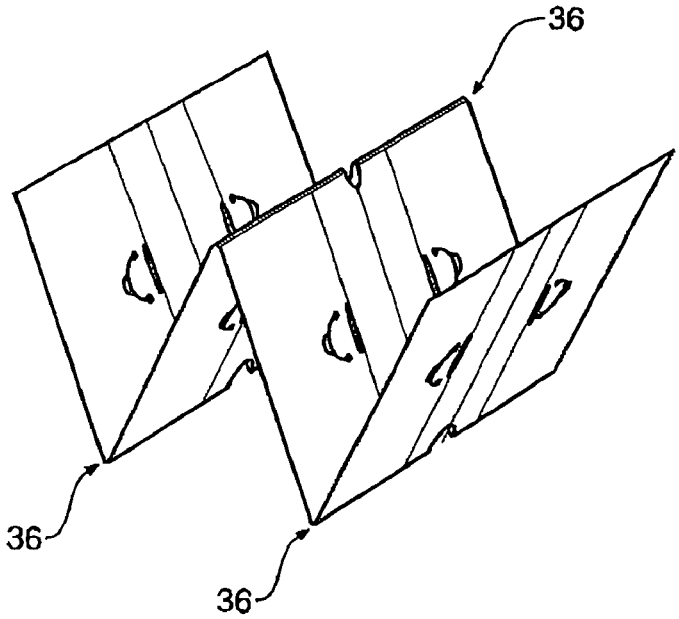
FIG. 7 shows the folding display apparatus in a further partly folded state.
Figure 8:
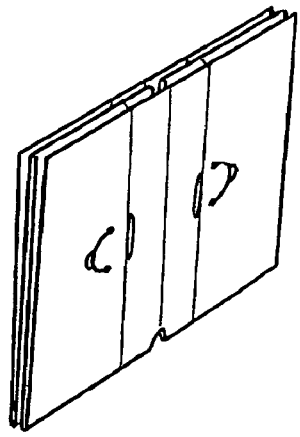
FIG. 8 shows the folding display apparatus when fully folded in its non-use storage condition.

FIGS. 6 to 8 show how the display apparatus 41 can be collapsed to ¼ of its original size (with or without the elastic bands 42 in place).

Figure 9:
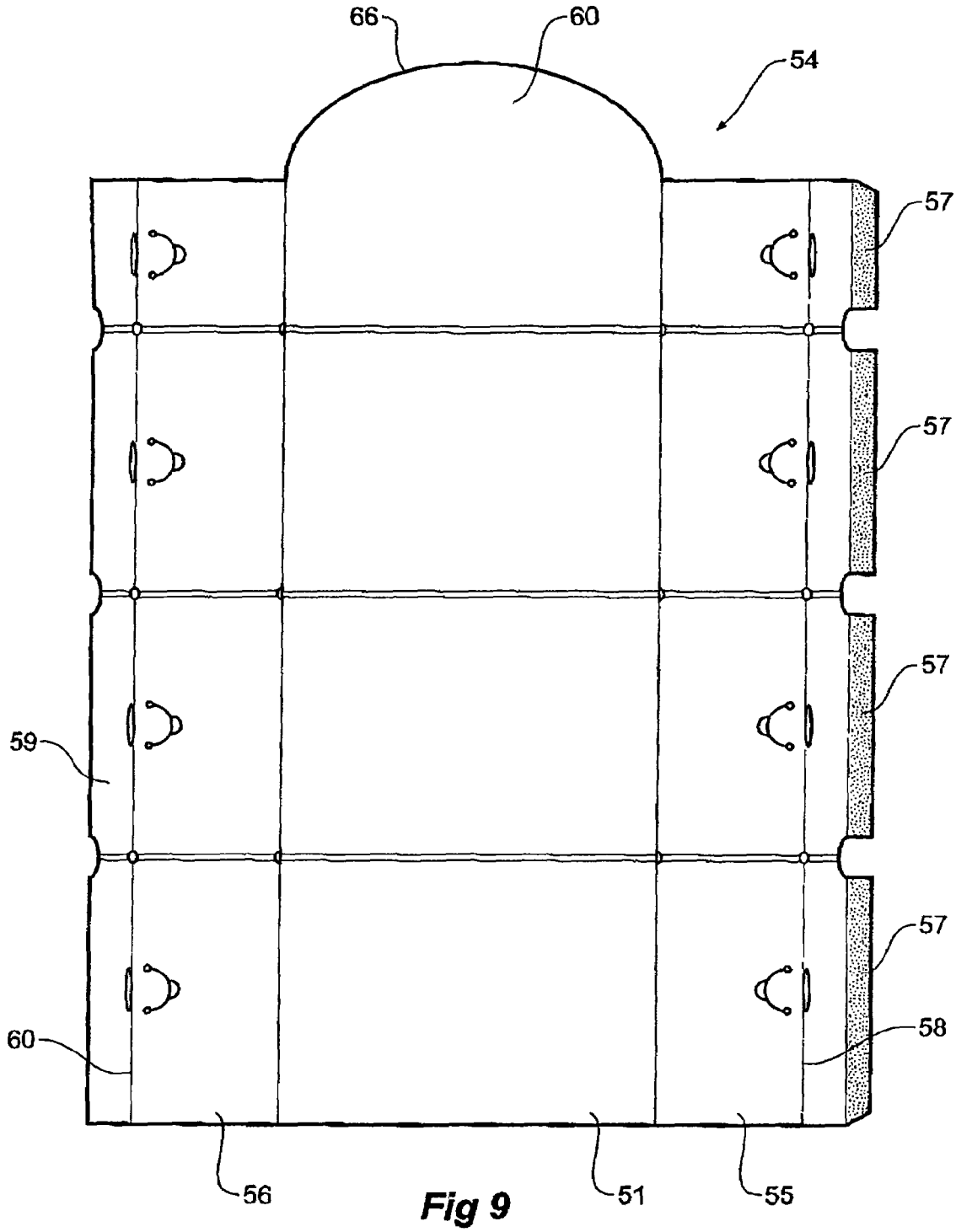
FIG. 9 is a plan view of an alternative blank sheet from which a display apparatus is formed according to a second embodiment of the present invention.
Figure 10:
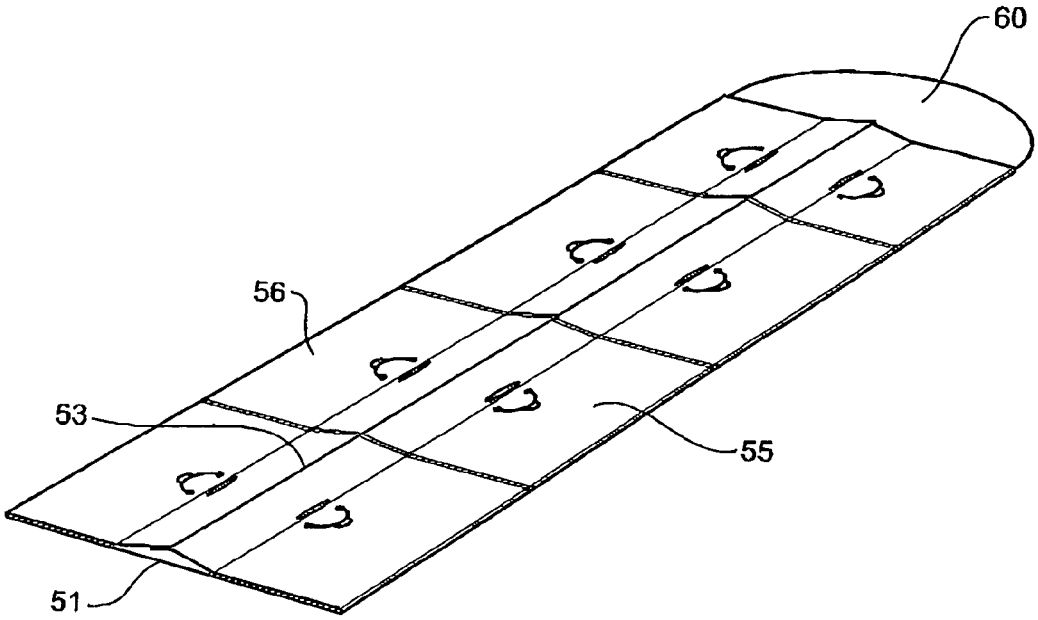
FIG. 10 is a perspective view of the blank shown in FIG. 9 in a partly folded state.
Figure 11:
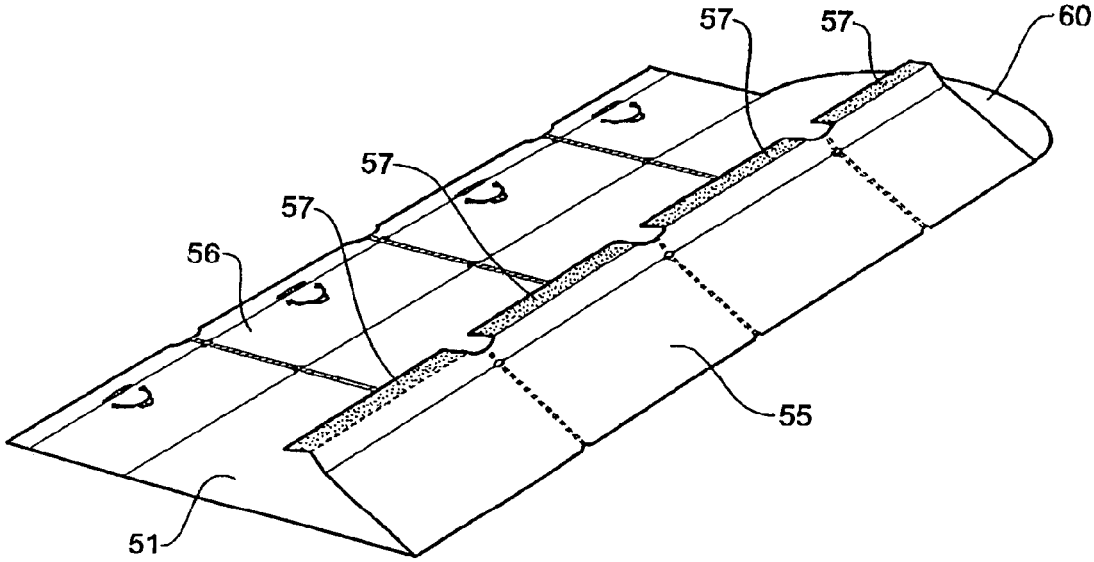
FIG. 11 is a perspective view of the display apparatus in a folded, flattened state wherein the blank shown in FIG. 10 has been folded to form the front and the rear panels and joined along their abutting edges.
Figure 12:
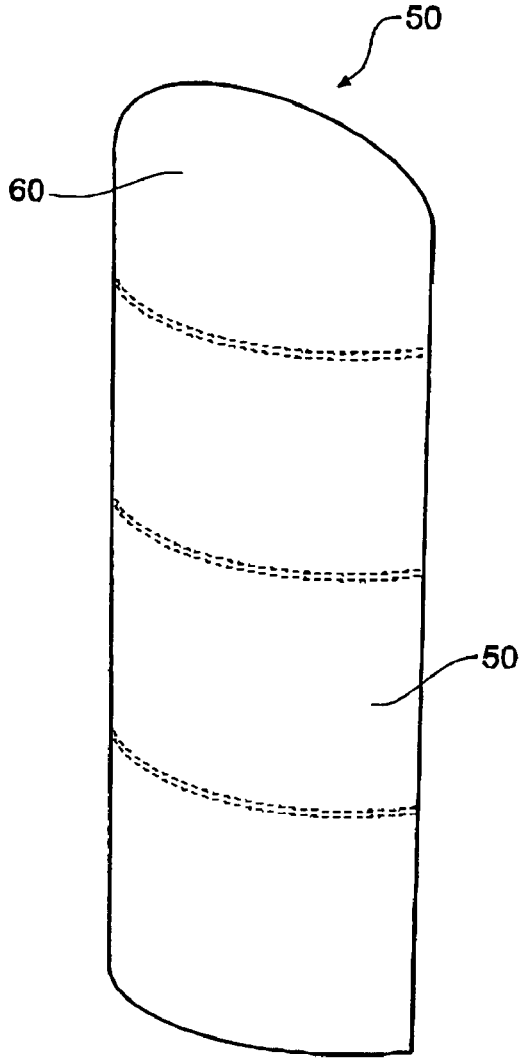
Figure 13:
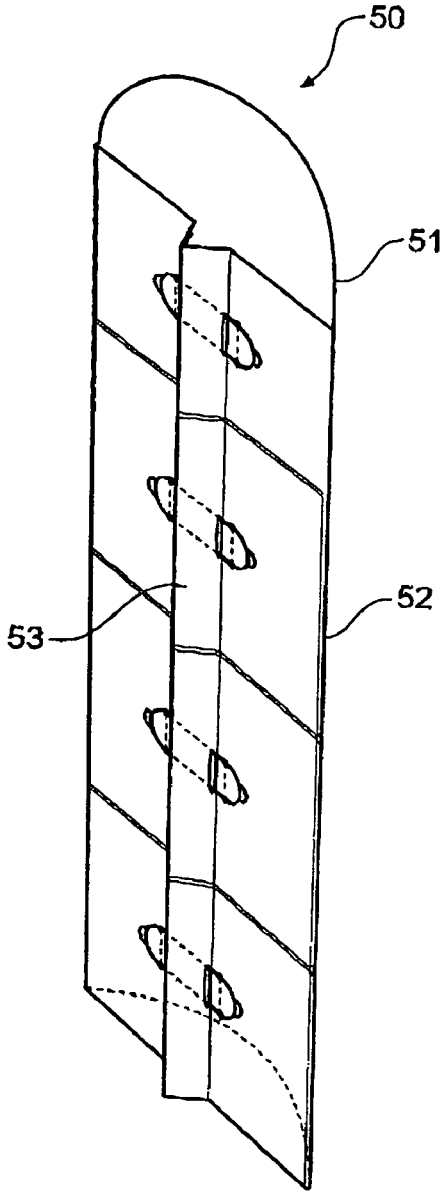
FIG. 13 is a rear view of the apparatus shown in FIG. 12.

Referring now to the second embodiment of the invention illustrated in FIGS. 9 to 13 of the accompanying drawings, there is shown a display unit 50 having a front panel 51, a rear panel 52 hingedly joined to the front panel 51 and a rearwardly projecting spine 53, formed in the rear panel 52. The assembled unit 50 is constructed essentially the same as the display unit shown in FIGS. 1 to 8 of the drawings. In this embodiment however, the blank 54 used for producing the display unit 50 is cut differently to the blank used for producing the display unit according to the first embodiment. As shown in FIG. 9, the rear panel of the display unit 50 is formed by two half panel sections 55, 56 which, when folded over, overlap one another and are joined together by means of adhesive. The half panel section 55 is provided with a plurality of hinged flaps 57 which are joined to the half panel section 55 along fold line 58, while half panel section 56 has a hinged flap 59 which can be hinged about a fold line 60. When the two half panel sections 55, 56 are folded over, the hinged flap 59 overlaps and is joined to the flaps 57, with the join being located to one side of the fold line 58 which defines the apex of the V-shaped spine 53 which extends between the top and bottom edges of the rear panel 52. The joining together of the opposite sides of the blank 54 in this manner facilitates the manufacture of the display unit.

It will also be seen that front panel 51 of the display unit 50 has a height greater than that of the rear panel 52, this being achieved by means of an integral extension portion 60 which is formed with a curved perimeter edge 66. The extension portion 60 effectively extends the height of the front panel once the display apparatus is constructed and allows additional material to be displayed in an aesthetically pleasing manner.

As is the case with the display apparatus produced in accordance with the first embodiment, display unit 50 can be collapsed to ¼ of its original size (with or without the elastic bands).

The folding display apparatus is desirably produced from a single sheet of material. A one piece construction makes for a more rigid and aesthetically pleasing unit. In addition it reduces the manual labour involved in assembly and also eliminates the number of components that go into producing the display.

It will be understood that the invention is not limited to the specific features of the preferred embodiments described herein and before but is capable of numerous re-arrangements, modifications and substitutions without departing from the scope of the invention. Modifications and variations such as would be apparent to a skilled addressee are deemed within the scope of the present invention.

For example, the skilled addressee will understand that the dimensions of the sheet can be altered to any desired length or width. The fold lines running across the width of the sheet can be altered to be any number such that permits the unit to fold to a substantially flat package. Desirably the apparatus can be fully collapsed to ¼ of its original size, however, any size smaller than the apparatus when assembled will suffice.

The skilled addressee would also understand that the front panel can be joined to the rear panel by any means which permits hinging movement of the panels when the display apparatus is being assembled or collapsed.

These examples are not intended as an exhaustive list, and are only intended to be indicative of other embodiments still in accordance with the present invention.

The invention claimed is:

1. A display apparatus of the kind comprising a front panel on which visual information is displayed, a rear panel hingedly joined to said first panel along its opposite longitudinal margins, and a plurality of vertically spaced traction members attached to the rear panel and arranged, when the display unit is in its in-use position, to tension the rear panel so that the front panel is caused to assume a convex shape, the improvement wherein:

(i) said rear panel includes an integrally formed rearwardly projecting spine extending between the upper and lower edges of the rear panel centrally thereof, said rearwardly projecting spine being delineated by a plurality of parallel, spaced apart fold lines extending longitudinally between said upper and lower edges of the rear panel and, (ii) each of said traction members extends across and through said spine, and each having ends which are anchored at locations in the rear panel spaced outwardly of the sides of the spine.

2. A display apparatus according to claim 1, wherein the spine is V-shaped and is formed by three said parallel spaced apart fold lines which allow the rear panel under the tension of the traction members, to fold up onto itself so as to create the V-shaped integral spine.

3. A display apparatus according to claim 1, wherein the traction members comprise a plurality of elastic bands spaced vertically along the length of the spine, with each band passing through aligned openings or cut-outs formed in said spine on opposite sides thereof.

4. A display apparatus according to claim 3, wherein the elastic bands are attached by means of arcuate slits or cut-outs formed in the rear panel adjacent opposite sides of the integrally formed spine.

5. A display apparatus according to claim 1, wherein the front and rear panels are formed from a single blank of a suitable flexible material.

6. A display apparatus according to claim 5, wherein the blank is provided with an approximately centrally located vertically extending fold line which divides the blank into said front and rear panels on opposites thereof, and a plurality of vertically spaced horizontally extending fold lines which run the full width of said blank, said horizontal fold lines dividing each of the front and rear panels into a plurality of folding portions which can fold onto one another.

7. A display apparatus according to claim 5 wherein said rear panel comprises two half panels having overlapping inner marginal portions joined together by adhesive means.

8. A display apparatus according to claim 6, wherein the spine has a plurality of vertically spaced apart cut-outs located at the intersections of the vertical fold lines and the horizontal fold lines, so as to allow easy folding without buckling.

9. A display apparatus according to claim 6, wherein one side of the blank terminates in a plurality of inwardly foldable flaps which when the blank is folded, are affixed to the other opposite margin of the blank to thereby form the front and rear panels which overlie one another when in a flattened condition.

10. A display apparatus according to claim 1 wherein the height of the front panel is greater than that of the rear panel.

11. A display apparatus according to claim 10 where the top perimeter edge of the front panel is curved.

12. A display apparatus according to claim 2, wherein the traction members comprise a plurality of elastic bands spaced vertically along the length of the spine, with each band passing through aligned openings or cut-outs formed in said spine on opposite sides thereof.

13. A display apparatus according to claim 12, wherein the elastic bands are attached by means of arcuate slits or cut-outs formed in the rear panel adjacent opposite sides of the integrally formed spine.

* * * * *